United States Patent [19]

Oogami

[11] 4,100,704

[45] Jul. 18, 1978

[54] ADJUSTABLE TRANSOM ASSEMBLY

[75] Inventor: Eiryo Oogami, Kurobe, Japan

[73] Assignee: Yoshida Kogyo K.K., Tokyo, Japan

[21] Appl. No.: 724,594

[22] Filed: Sep. 17, 1976

[30] Foreign Application Priority Data

Sep. 22, 1975 [JP] Japan ..... 50-130425[U]

[51] Int. Cl.[2] ..... E04D 1/35

[52] U.S. Cl. ..... 52/65; 52/277; 52/282

[58] Field of Search ..... 52/281, 201, 277, 475, 52/65, 397, 400, 282; 16/178

[56] References Cited

U.S. PATENT DOCUMENTS

| | | | |
|---|---|---|---|
| 2,144,515 | 1/1939 | Trumpbour | 52/282 |
| 2,934,179 | 4/1960 | Larsen | 52/282 |
| 3,196,992 | 7/1965 | Owen | 52/282 |
| 3,210,808 | 10/1965 | Creager | 52/282 |

*Primary Examiner*—Ernest R. Purser
*Assistant Examiner*—Carl D. Friedman
*Attorney, Agent, or Firm*—Hill, Gross, Simpson, Van Santen, Steadman, Chiara & Simpson

[57] ABSTRACT

An adjustable transom assembly is adaptable for a variety of differenty angled mullions each having two portions inclined at an angle with respect to each other and joined together by the assembly. The assembly has a first hollow member mounted on one of the portions of the mullion and having an arcuate wall, and a projection with a semi-cylindrical end portion located at the center of curvature of the arcuate wall. A second member has an elongated arcuate recess receiving the semi-cylindrical end portion and is tiltable about the end portion, the second member including an arm movable over the arcuate wall and connected to one of a plurality of selectable positions on the arcuate wall. The selected position causes the second member to be inclined at the afore-mentioned angle with respect to the first member. A third interconnecting member has a pair of side walls slanted at the afore-mentioned angle with respect to each other and having their marginal edges fixed to the first and second members, respectively, by means of machine screws.

9 Claims, 6 Drawing Figures

ADJUSTABLE TRANSOM ASSEMBLY

BACKGROUND OF THE INVENTION

1. Field of the Invention

This invention relates to a transom assembly adjustable for use with a variety of mullions having portions of different angles of elevation.

2. Prior Art

Buildings requiring much more natural lighting incorporate angled mullions, and transom assemblies for use therewith should of necessity have cross-sections conforming to the angled mullions. One known such assembly is shown in FIG. 5 of the accompanying drawings, which comprises various forms of structural bar members made by bending sheets of aluminum to desired cross-sectional shapes and joined together by means of machine screws. The prior transom bar assembly has had to be specially constructed for each different angle of elevation of the mullions in use, thereby causing the manufacturer and the vendor to make and stock a wide variety of different transom bar assemblies.

SUMMARY OF THE INVENTION

A primary object of the present invention is to provide a transom assembly having means adjustable for use with a variety of differently angled mullions.

Another object of the present invention is to provide a transom assembly that can be assembled with ease.

Still another object of the present invention is to provide a transom assembly having a pleasing appearance.

In accordance with the present invention, a transom assembly is adjustable for attachment to a mullion having two portions inclined at an angle with respect to each other. The assembly has a first member adapted to be fixed to one of the portions of the mullion and having an arcuate wall and first means located substantially at the center of curvature of the arcuate wall. The assembly also has a second member engageable with the other mullion portion, and; having second means engaging the first means and tiltable about the first means, the second member including an arm movable over the arcuate wall and connected to the arcuate wall at a selected one of a plurality of positions thereon, and the selected position causing the second member to be inclined at the afore-mentioned angle with respect to the firt member. The assembly further includes a third member having a pair of wall portions inclined at the afore-mentioned angle with respect to each other and having their marginal edges fixed to the first and second members, respectively.

Many other advantages and features of the present invention will become manifest to those versed in the art upon making reference to the detailed description and the accompanying sheets of drawings in which preferred structural embodiments incorporating the principles of the present invention are shown by way of illustrative example.

DESCRIPTION OF THE PREFERRED EMBODIMENTS

Figure 1:
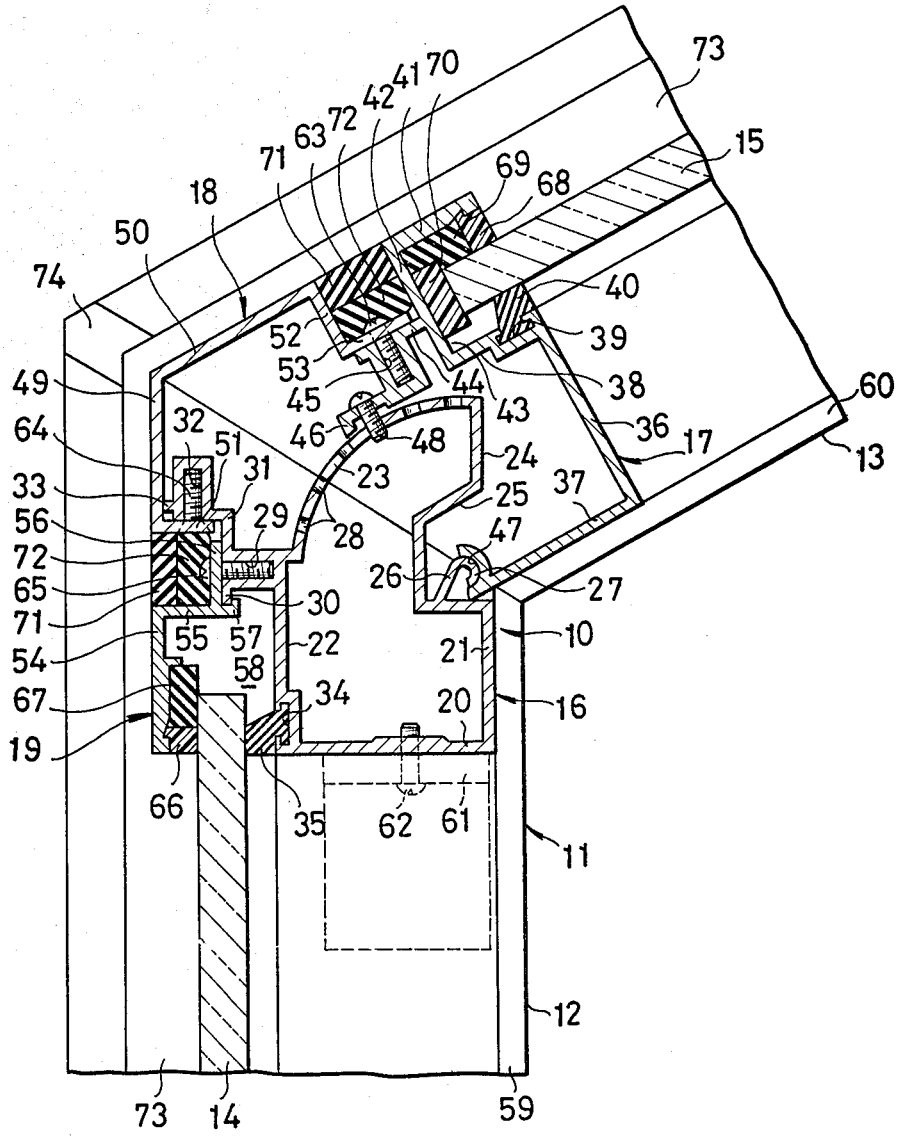
FIG. 1 is a vertical cross-sectional view of an assembled transom adjusted for and attached to an angled mullion.

FIG. 1 shows a transom assembly 10 extending horizontally between and attached to a pair of angled mullions 11, only one of the latter being illustrated here for clarity. The mullion 11 has a vertical lower portion 12 and an upper portion 13 connected to and inclined at an angle with respect to the vertical lower portion 12. Between the pair of mullions, there are a pair of panel members such as glass panes 14,15 extending in weather sealing relation along the vertical power portion 12 and the inclined upper portion 13, respectively. The transom assembly 10 is located where the upper and lower portions 13 and 14 are coupled together, and supports the glass panes 14,15 that are inclined with respect to each other.

The transom assembly 10 comprises a first or hollow fixed member 16, a second or tiltable member 17, a third or interconnecting member 18, and a panel support member 19, these members being all formed of extruded structural bars made typically of aluminum. The hollow member 16 includes a bottom wall 20, a pair of inner and outer side walls 21 and 22 extending perpendicularly from the opposite edges of the bottom wall 20, an arcuate wall 23 extending from one side of the free edge of the outer side wall 22, and a joint wall 24 extending between the respective free edges of the arcuate wall 23 and the inner side wall 21. The joint wall 24 has a recess or channel 25 in which there is an elongated projection 26 formed integrally with the joint wall. The projection 26 has a turned or rounded end 27 having a semi-cylindrical outer surface, the turned end 27 being located at the center of curvature of the arcuate wall 23 which is formed substantially as a 90° arc. A plurality of internally threaded or tapped holes 28 are formed through the arcuate wall 28 in circumferentially spaced and aligned relation. (Screw threads have been omitted from the drawings in the holes 28. However, as a screw 48 described below can be self-tapping, the drawing is not incorrect).

An elongated channel 29 is provided on the other side of the free edge of the outer side wall 22 and extends perpendicularly from the wall 22. A relatively small projection 30 and an oppositely disposed L-shaped flange 31 are formed integrally with the channel 29 and are parallel to the outer side wall 22, the L-shaped flange 31 in turn supporting an integrally formed elongated channel 32 arranged perpendicularly to the channel 29. The channel 32 is formed with a relatively small projection 33 extending away from the outer side wall 22. An undercut channel or groove 34 is formed in the outer side wall 22 for retaining a sealing strip or gasket 35.

The tiltable member 17 comprises a bottom wall 36, a main side wall 37, and a relatively short inner side wall 38, the latter two side walls extending perpendicularly from the opposite edges of the bottom wall 36. The inner side wall 38 has an undercut channel or groove 39 therein retaining a sealing strip or gasket 40. An outer side wall 41 is provided in oppositely facing relation to the inner side wall 38 and is connected to the latter by a bottom wall 42 extending parallel to the bottom wall 36. The inner and outer side walls 38, 41 and the bottom wall 42 jointly define a channel 43 receiving a peripheral margin of the glass pane 15. A leg 44 extends from the underside of the bottom wall 42 and is located centrally between the outer side wall 41 and the inner side wall 38. The leg 44 has an elongate channel 45 extending parallel to the bottom wall 42, the channel 45 having an arm 46 extending perpendicularly therefrom. The main side wall 37 has on its free edge an arcuate support recess 47 with which the arcuate outer support surface of the projection 26 is snugly engageable. The tiltable member 17 can pivot about the arcuate support surface of the projection 26 so as to enable the arm 46 to move over the outer surface of the arcuate wall 23 between the opposite extremities of the latter. According to the illustrated embodiment, the tiltable member 17 can be inclined at an angle ranging from 10° to 90° with respect to the fixed member 16. The arm 46 has a hole through which a machine screw 48 can pass freely. The screw 48 extending through the arm 46 can be threaded into any one of the tapped holes 28 to prevent the member 27 from pivotal movement about the rounded end 27.

The interconnecting member 18 has a vertical side wall 49 and a side wall 50 inclined with respect to the vertical side wall 49. The vertical side wall 49 includes an inturned flange 51 extending perpendicularly from the wall 49 and having a hole formed therethrough. The inclined side wall 50 has an L-shaped flange 52 disposed oppositely to the inturned flange 51 and including a wall portion 53 extending parallel to the inclined side wall 50, the wall portion 53 having a hole therethrough. The interconnecting member 18 when assembled provides registration of the hole in the inturned flange 51 with the channel 32 and of the hole in the wall portion 53 with the channel 45. The interconnecting members are available in a variety of angles formed between the vertical side wall 49 and the inclined side wall 50, there being as many angles obtainable as there are differently angled mullions.

The panel support member 19 comprises a base wall portion 54 and an inturned L-shaped flange 55 formed integrally with the wall portion 54 and including a portion 56 parallel to the wall portion 54, the portion 56 having a hole formed therethrough. A relatively small L-shaped flange 57 extends inwardly from the flange 55 beyond the portion 56. The panel support member 19 when installed on the hollow fixed member 16 permits the small L-shaped flange 57 to fit over the projection 30 with the through hole in the portion 56 held in registration with the channel 29. The outer side wall 22 of the member 16 and the attached panel support member 19 jointly provide a channel 58 receiving a peripheral margin of the glass pane 14.

For assembly of the angled mullion 11, the upper and lower portions 13 and 12 are provided with a miter joint, the angle of inclination of the upper portion 13 with respect to the lower portion 12 being preselected. The lower and upper portions 12 and 13 have raised margins 59 and 60, respectively. The vertical lower portion 12 has a bracket 61 on which the hollow member 16 is mounted by means of a machine screw 62 with the inner side wall 21 held against the side of the raised margin 59. The tiltable member 17 is then installed with the arcuate recess 47 receiving the semi-circular or rounded end 27. The member 17 is tilted about the rounded end 27 until the side wall 37 comes into abutment against the side of the raised margin 60, when the angle of inclination of the member 17 with respect to the fixed member 16 conforms to the preselected angle of the inclined mullion portion 13. The tiltable member 17 is fixed to the member 16 by the screw 48 extending through the arm 46 and threaded into a selected one of the tapered holes 28.

An interconnecting member 18 is selected from a stock of differently angled members which has an angle of inclination of the side wall 50 conforming to the preselected angle of inclination of the upper portion 13 of the mullion 11. The selected member 18 is attached by a pair of screws 63 and 64 extending through the portion 53 into the channel 45 and through the flange 51 into the channel 32, respectively. The panel support member 19 is secured to the fixed member 16 by a screw 65 extending through the portion 56 into the channel 29, the peripheral margin of the glass pane 14 being held in the channel 58 with the gasket 35 interposed between one side of the pane 14 and the side wall 22. Another gasket 66 is interposed between the other side of the pane 14 and the wall portion 54. To prevent the glass pane 14 from lateral displacement, a panel support element 67 is provided in the channel 58. The peripheral margin of the glass pane 15 is held in the channel 43 with the gasket 40 interposed between the side wall 38 and one side of the margin of the glass pane 15. Between the other side of the glass margin and the side wall 41, there are provided a gasket 68 and panel support element 69. A panel positioning and bearing member 70 is disposed within the channel 43 and interposed between the bottom wall 42 and the lower edge of the glass pane 15. There are a pair of rectangular spaces defined by the L-shaped flange 52 and the bottom wall 42, and by the L-shaped flange 55 and the flange 51, respectively, each space being filled up with a pair of weather strips 71 and 72. An additional weather strip 73 provides sealing between the mullion 11, and the panes 14,15 and the transom assembly 10. Since the upper portion 13 and the lower portion 12 are separate members, a sealing strip 74 is used to seal the edges where they are joined together and exposed to weather.

Because the structural members making up the transom assembly 10 have extended length, the screws 48, 63, 64 and 65 are each provided at spaced locations along the length of the assembly 10. Likewise, rows of the aligned tapped holes 28 are provided at intervals spaced along the length of the assembly 10.

Figure 2:
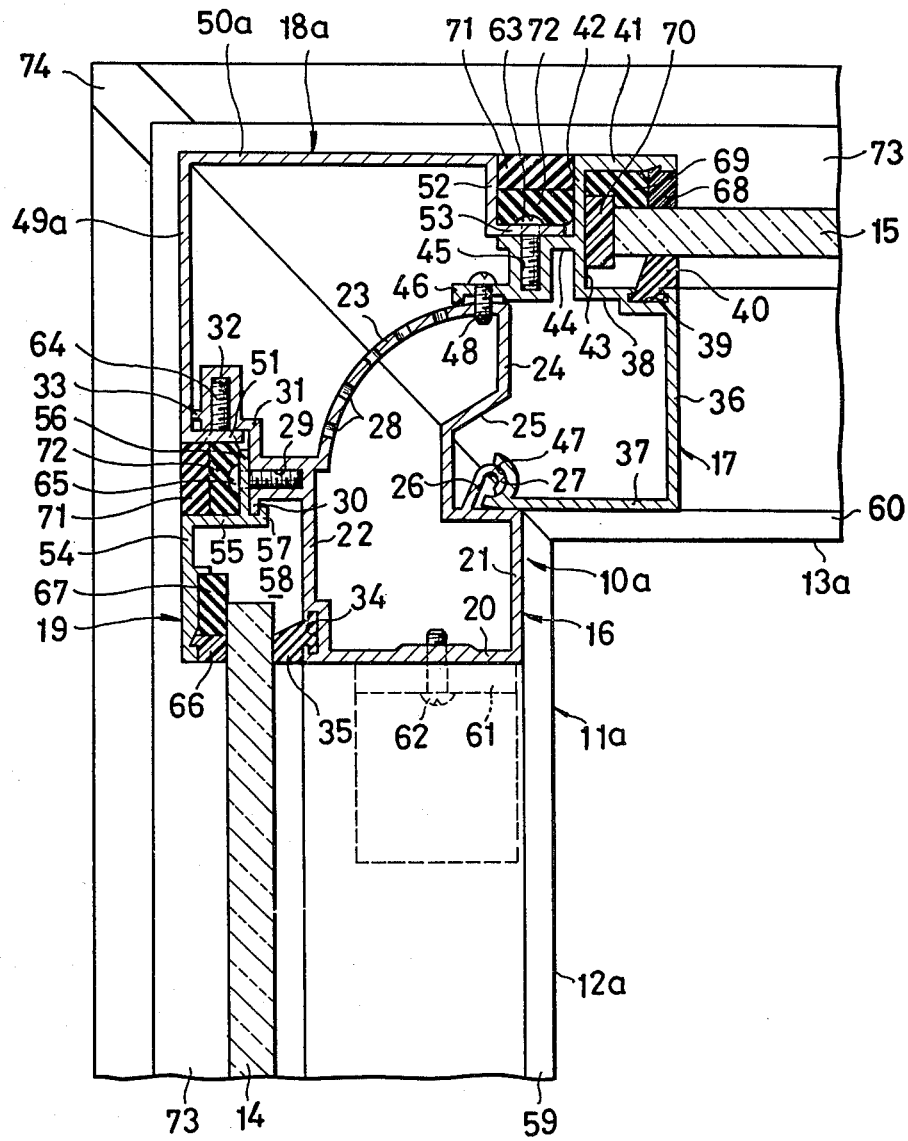
FIG. 2 is a view similar to FIG. 1 but showing a transom adjusted for and attached to a differently angled mullion.

In FIG. 2, a transom assembly **10*a* lends itself to installation on a mullion 11*a* comprising a pair of perpendicularly arranged lower and upper portions 12*a*, 13*a*. The transom assembly 10*a* includes an interconnecting member 18*a* having a vertical side wall 49*a* and a horizontal side wall 50*a*. With this arrangement, the tiltable member 17 needs to pivot about the rounded end 27 until the member 17 is inclined at a right angle with respect to the fixed member 16**.

Figure 3:
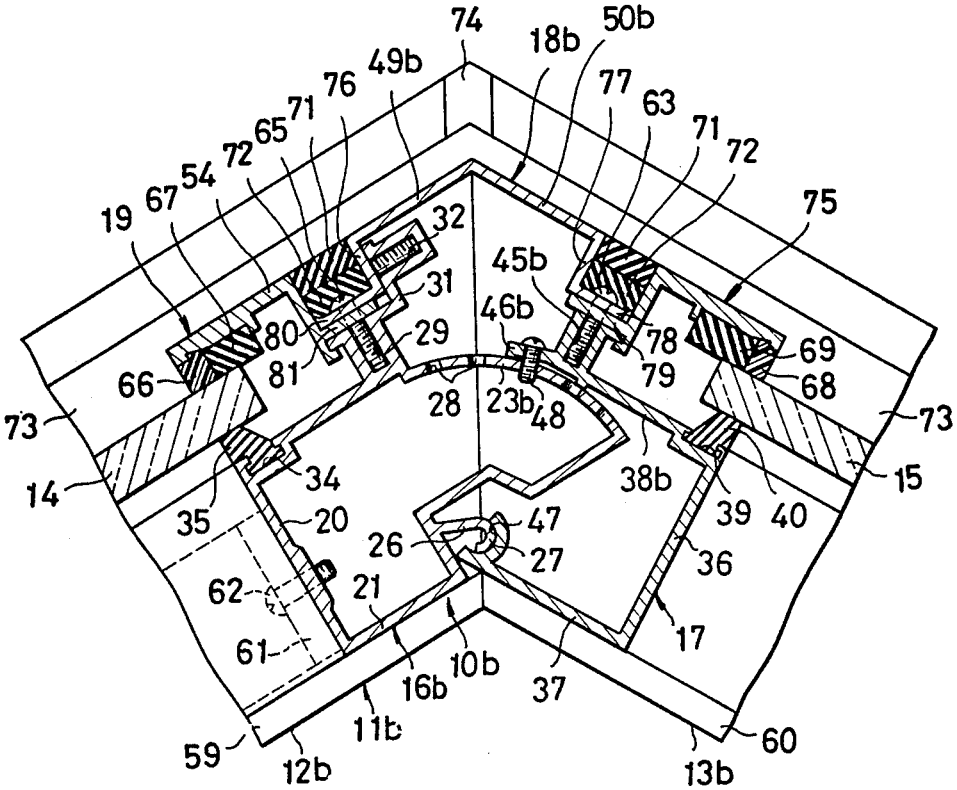
FIG. 3 is a vertical cross-sectional view of a modified transom assembly used as the ridge of a roof.

The transom bar assembly of this invention can be used as the ridge of a roof as shown in FIG. 3. A transom assembly **10*b* for the ridge is different from the previous embodiments in that it utilizes another panel support member 75 for the glass pane 15, and a modified interconnecting member 18*b*. The panel support member 75 is required for the attachment of the glass pane 15. In assembly, the upper margins of the glass panes 14, 15 are first mounted on the gaskets 35, 40, respectively, and then the panel support member 19, 75 are secured to the fixed member 16*b* and the tiltable member 17, respectively. Between the glass pane 14 and the panel support member 19, the gasket 66 and the panel support element 67 are interposed, and between the glass pane 15 and the panel support member 75, the gasket 68 and panel support element 69 are interposed. The interconnecting member 18*b* has a pair of side walls 49*b*, 50*b* inclined at an angle with respect to each other, and a pair of L-shaped flanges 76, 77 for attachment to the fixed member 16 and the tiltable member 17, respectively. The interconnecting member 18*b* is fixed by the screws 63 and 65 extending through portions 78 and 79 into the channel 45*b*, and through portions 80 and 81 into the channel 29**, respectively.

The fixed member 16b has a slightly shorter arcuate wall **23*b* having one less hole 28**.

Figure 4A:
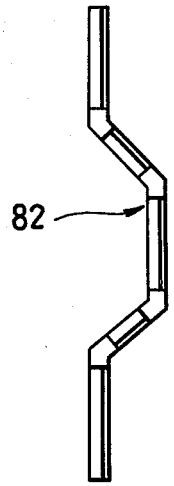
FIGS. 4A and 4B are schematic views of building frameworks both utilizing the transom assemblies of the invention.

FIG. 4A illustrates an upstanding framework 82 in which a plurality of transom assemblies are employed to form a recessed wall structure.

Figure 4B:
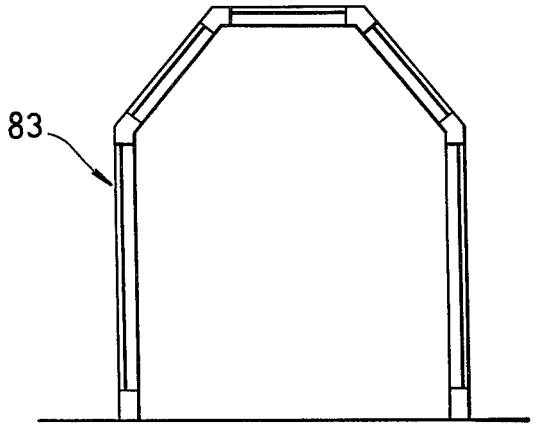
Figure 5:
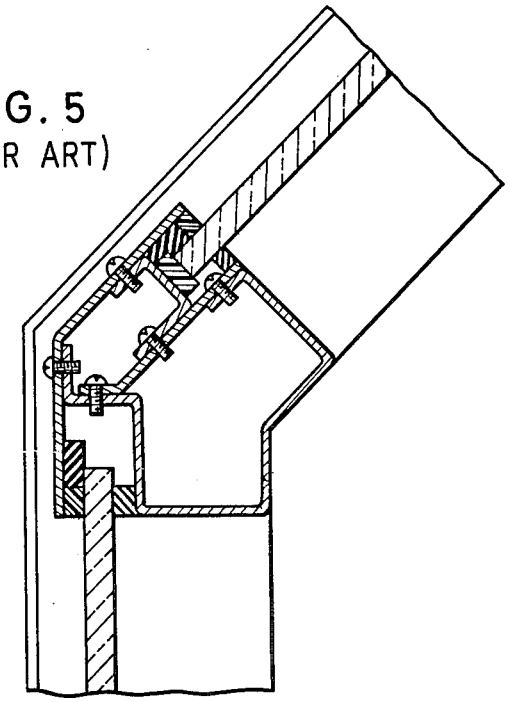
FIG. 5 (PRIOR ART)
FIG. 5 is a vertical cross-sectional view of a conventional transom assembly.

FIG. 4B shows an enclosure framework 83 used, for example, as a connecting corridor in which all panel members are interconnected by a plurality of transom assemblies of this invention.

The transom assembly of the invention is adaptable for differently angled mullions simply by tilting the member 17 with respect to the member 16 and by putting the screw 48 into selected one of the tapped holes 28 formed through the arcuate wall 23. Each of the component members of the assembly is an extrusion and can be produced uniformly and to a nicety without having regard to the angles of elevation of the upper portion 13.

The terms "upper" and "lower" used above have reference to the mullion in its usual position of operation, as shown in FIG. 1. The words "inner" and "outer" used above are used with reference to the geometric center of the building structure in which the transom assembly is used.

Although various minor modifications may be suggested by those versed in the art, it should be understood that I wish to embody within the scope of the patent warranted hereon, all such embodiments as reasonably and properly come within the scope of my contribution to the art.

What I claim as my invention:

1. An adjustable transom assembly for attachment to a mullion having two portions inclined at an angle with respect to each other, comprising:

(a) a first member adapted to be fixed to one of the portions of the mullion and having an arcuate wall;

(b) first arcuate support means located substantially at the center of curvature of said arcuate wall and radially spaced from said arcuate wall, and carried by said first member;

(c) a second member adapted to be fixed to the other of the portions of the mullion;

(d) second arcuate support means carried by said second member and engaging said first arcuate support means and tiltable about the axis of said first arcuate support means with a corresponding variable portion of said arcuate wall being received in said second member;

(e) an arm secured to said second member and freely movable over the convex side of said arcuate wall remotely from both said arcuate support means, and releaseably connected to said arcuate wall at a selected position causing said second member to be inclined at the afore-mentioned angle with respect to said first member;

(f) a third member having a pair of wall portions inclined at the first-mentioned angle with respect to each other and having their ends, as viewed in transverse cross-section, fixed to said first and second members, respectively, in surrounding relation to said convex side of said arcuate wall; and (g) said arcuate wall being enclosed between said third member and said first and second arcuate support means.

2. An adjustable transom assembly according to claim 1, in which said first member is hollow with a continuous cross-section comprising:

(a) a bottom wall;

(b) two spaced parallel side walls extending perpendicularly from said bottom wall, said arcuate wall extending from one of said side walls; and (c) a joint wall extending between said arcuate wall and the other of said side walls, and supporting said first arcuate support means.

3. An adjustable transom assembly according to claim 2, each of said first and second members having a channel for the reception of the margin of a panel member in a plane perpendicular to said bottom wall, one of said channels being formed in part by a panel support member having one marginal portion spaced from, and a second remote marginal portion fixed to, said one of said side walls of the first member, said panel support member being substantially coextensive with said one of said side walls.

4. An adjustable transom assembly according to claim 2, said first arcuate support means being a rounded end fixedly supported in a recess in said joint wall concentrically with said arcuate wall and disposed in a further recess in said second arcuate support means.

5. An adjustable transom assembly according to claim 1 in which said second member comprises a bottom wall and two spaced side walls extending perpendicularly from said bottom wall, one of said side walls of said second member supporting said second arcuate support means, both said first and second arcuate support means disposed in a recess in said first member, and said arcuate wall of said first member being receivable between said spaced side walls and spaced therefrom.

6. An adjustable transom assembly according to claim 5, each of said first and second members having a channel for the reception of the margin of a panel member in a plane perpendicular to said bottom wall, one of said channels being formed by a panel support member having one marginal portion spaced from, and a second remote marginal portion integral with, the other of said side walls of the second member, said panel support member being substantially coextensive with said other of said side walls.

7. An adjustable transom assembly according to claim 5, said first arcuate support means being fixedly supported in a recess in said first member, said second arcuate support means being an arcuate recess formed on the free end of said one of said side walls of the second member in spaced relation to said arm, said arcuate recess facing said recess in said first member, said arm being on the other of said side walls.

8. An adjustable transom assembly according to claim 1, said arcuate wall having a plurality of circumferentially spaced tapped holes defining said positions and said arm having a hole through which a screw extends, across a space between said arm and said arcuate wall, and into a selected one of any of said tapped holes.

9. An adjustable transom assembly according to claim 1, said arcuate wall being fully enclosed and surrounded by said first and second members and said third member jointly.

* * * * *